US005803546A

United States Patent [19]

Yamazaki

[11] Patent Number: 5,803,546

[45] Date of Patent: Sep. 8, 1998

[54] TURNING MECHANISM FOR CHAIR SEAT

[75] Inventor: Ryokichi Yamazaki, Tokyo, Japan

[73] Assignee: Kabushiki Kaisha Kotobuki, Tokyo, Japan

[21] Appl. No.: 779,561

[22] Filed: Jan. 7, 1997

[30] Foreign Application Priority Data

Aug. 2, 1996 [JP] Japan ..... 8-235753

[51] Int. Cl.[6] ..... A47C 1/12

[52] U.S. Cl. ..... 297/333; 297/331; 297/332; 297/335

[58] Field of Search ..... 297/333, 331, 297/332, 335, 411.32

[56] References Cited

U.S. PATENT DOCUMENTS

| | | | |
|---|---|---|---|
| 984,474 | 2/1911 | Dann | 297/335 X |
| 1,958,061 | 5/1934 | Merrill | 297/332 |
| 1,973,178 | 9/1934 | Sass | 297/333 |
| 2,268,914 | 1/1942 | Vandervoort | 297/332 |
| 2,272,298 | 2/1942 | Hanson | 297/333 |
| 2,312,638 | 3/1943 | Gedris | 297/333 |
| 2,430,356 | 11/1947 | McDonald | 297/331 |
| 2,509,739 | 5/1950 | McDonald | 297/331 |
| 2,815,065 | 12/1957 | Morgan et al. | 297/333 |
| 2,828,803 | 4/1958 | Howe et al. | 297/333 |
| 2,913,039 | 11/1959 | Mauser | 297/333 X |
| 3,098,677 | 7/1963 | Williams | 297/332 X |
| 3,156,501 | 11/1964 | Harris | 297/333 |
| 3,287,060 | 11/1966 | Thompson | 297/332 |
| 3,690,726 | 9/1972 | Van Ryn | 297/332 |
| 4,854,640 | 8/1989 | Yokoyama | 297/333 |
| 5,393,120 | 2/1995 | Woods | 297/332 X |

FOREIGN PATENT DOCUMENTS

| | | | |
|---|---|---|---|
| 135466 | 4/1952 | Sweden | 297/333 |

*Primary Examiner*—Jose V. Chen
*Assistant Examiner*—Rodney B. White
*Attorney, Agent, or Firm*—Oldham & Oldham Co., LPA

[57] ABSTRACT

Disclosed is a turning mechanism for a chair seat which comprises a shaft having a square cross section and fixed to the leg of a chair having a seat, a spring disposed to the shaft with an end thereof locked to the shaft and the other end thereof engaged so as to be associated with the turning of the seat of the chair, a stopper inserted into and engaged with the shaft through a square hole defined at the center thereof, a stopper receiver having abutting portions formed thereto and abutted against projections formed to the stopper, a first bush inserted into and engaged with the shaft through a square hole defined at the center thereof; and a second bush inserted into and engaged with the shaft through a square hole defined at the center thereof, wherein the first bush, the stopper and the second bush are contained in the stopper receiver. With this arrangement, there is provided a compact turning mechanism for a chair seat which is lingt in weight and small in size and can reduce an assemblying job.

8 Claims, 6 Drawing Sheets

TURNING MECHANISM FOR CHAIR SEAT

BACKGROUND OF THE INVENTION

1. Field of the Invention

The present invention relates to improvement of a turning mechanism for a chair seat.

2. Description of the Related Art

There is a conventional turning mechanism for a chair seat disclosed in, for example, Japanese Unexamined Utility Model Publication No. 64-128 and since a seat contains a stopper and a stopper receiver for regulating a seat turning up and down range in the conventional turning mechanism, it is advantageous in outside appearance and durability.

However, since the above conventional turning mechanism for the chair seat is arranged to receive a load by one side of a stopper receiver having a mountain-shaped cross section, it has a problem that the dimension from a shaft axis to the surface of the stopper receiver where the load is received is somewhat increased and the stopper receiver is liable to be distorted.

Further, since the number of parts is increased, a time-consuming job is necessary to assemble the chair.

An object of the present invention is to provide a compact turning mechanism for a chair seat capable of reducing the distortion of a stopper receiver and decreasing an assembling job as much as possible by reducing the dimension from a shaft axis to the surface of a stopper receiver where a load is received to thereby descrease a weight and a size.

SUMMARY OF THE INVENTION

To achieve the above object, in the invention of claim 1, the above problems are solved by a turning mechanism for a chair seat which comprises a shaft having a square cross section and fixed to the leg of a chair having a seat, a spring disposed to the shaft with an end thereof locked to the shaft and the other end thereof engaged so as to be associated with the turning of the seat of the chair, a stopper inserted into and engaged with the shaft through a square hole defined at the center thereof, a stopper receiver having abutting portions formed thereto and abutted against projections formed to the stopper, a first bushing inserted into and engaged with the shaft through a square hole defined at the center thereof, and a second bushing inserted into and engaged with the shaft through a square hole defined at the center thereof, wherein the first bushing the stopper and the second bush are contained in the stopper receiver.

In the invention of claim 2, the turning mechanism for the chair seat according to claim 1 is preferably arranged such that the shaft has a cross section formed to a polygonal shape, holes each having a shape identical with the cross section of the shaft are formed to the first bush, the stopper and the second bushing respectively and the first bushing, the stopper and the second bushing are integrally arranged as a unit.

In the invention of claim 3, it is preferable that a recesses are formed to the stopper and projections to be engaged with the recesses are formed to the first bushing and the second bushing.

In the invention of claim 4, the turning mechanism for the chair seat according to claim 1 is preferably arranged such that the second bushing is composed of an elastic material and a vibration stopping guard portion is formed to the bushing so as to be engaged with the stopper receiver.

In the invention of claim 5, the turning mechanism for the chair seat according to any of claim 1 to claim 4 is preferably arranged such that each pair of the projections and the abutting portions are formed at positions symmetrical to the shaft.

DESCRIPTION OF THE PREFERRED EMBODIMENT

An embodiment of the present invention will be described with reference to FIG. 1 to FIG. 6. In the following description, a front side and a rear side when a person sits on a chair is called a front side and a rear side and the left side and the right side of the chair when it is viewed from the foreside thereof is called an outside and an inside.

Figure 1:
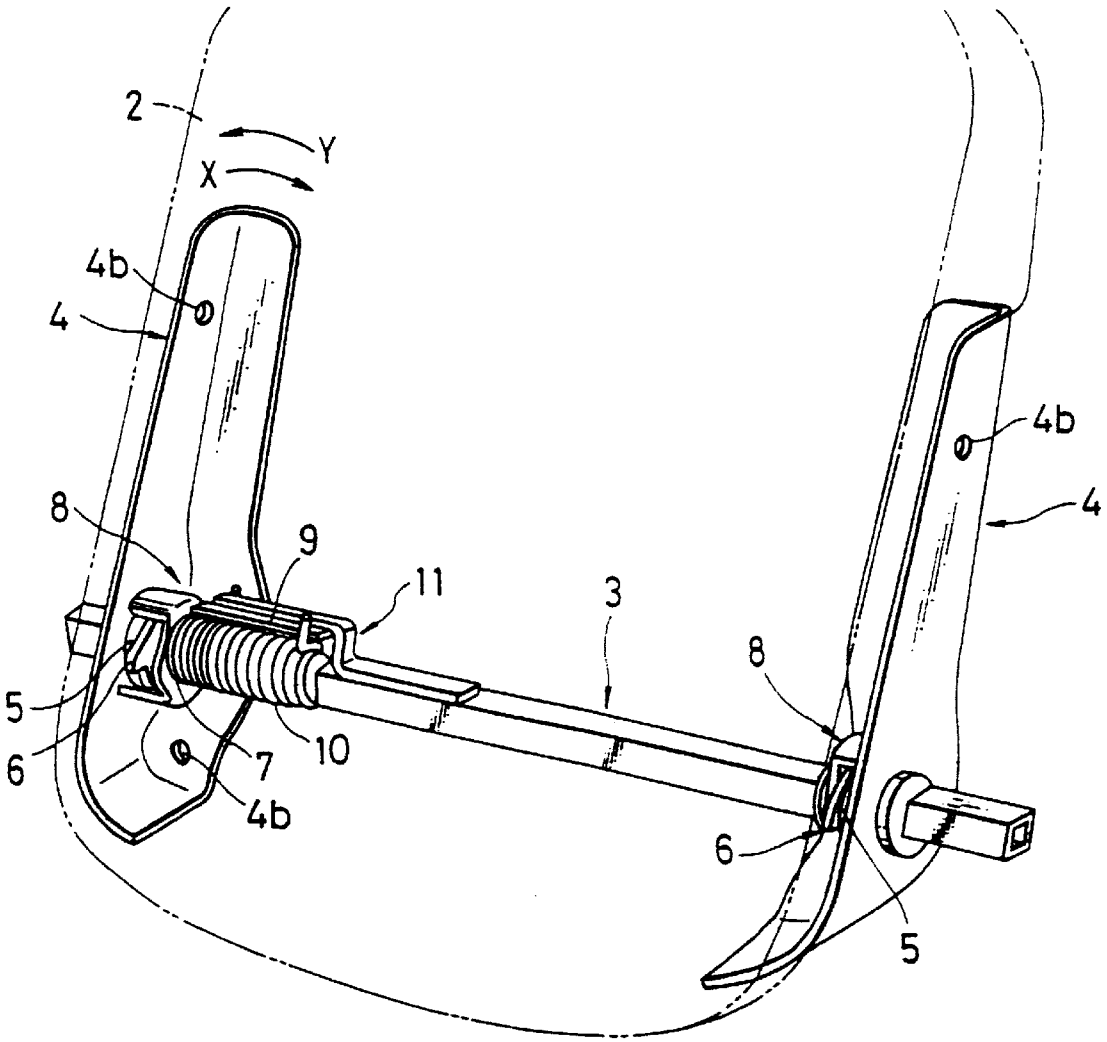
FIG. 1 a perspective view showing an embodiment of a turning mechanism for a chair seat of the present invention.
Figure 2:
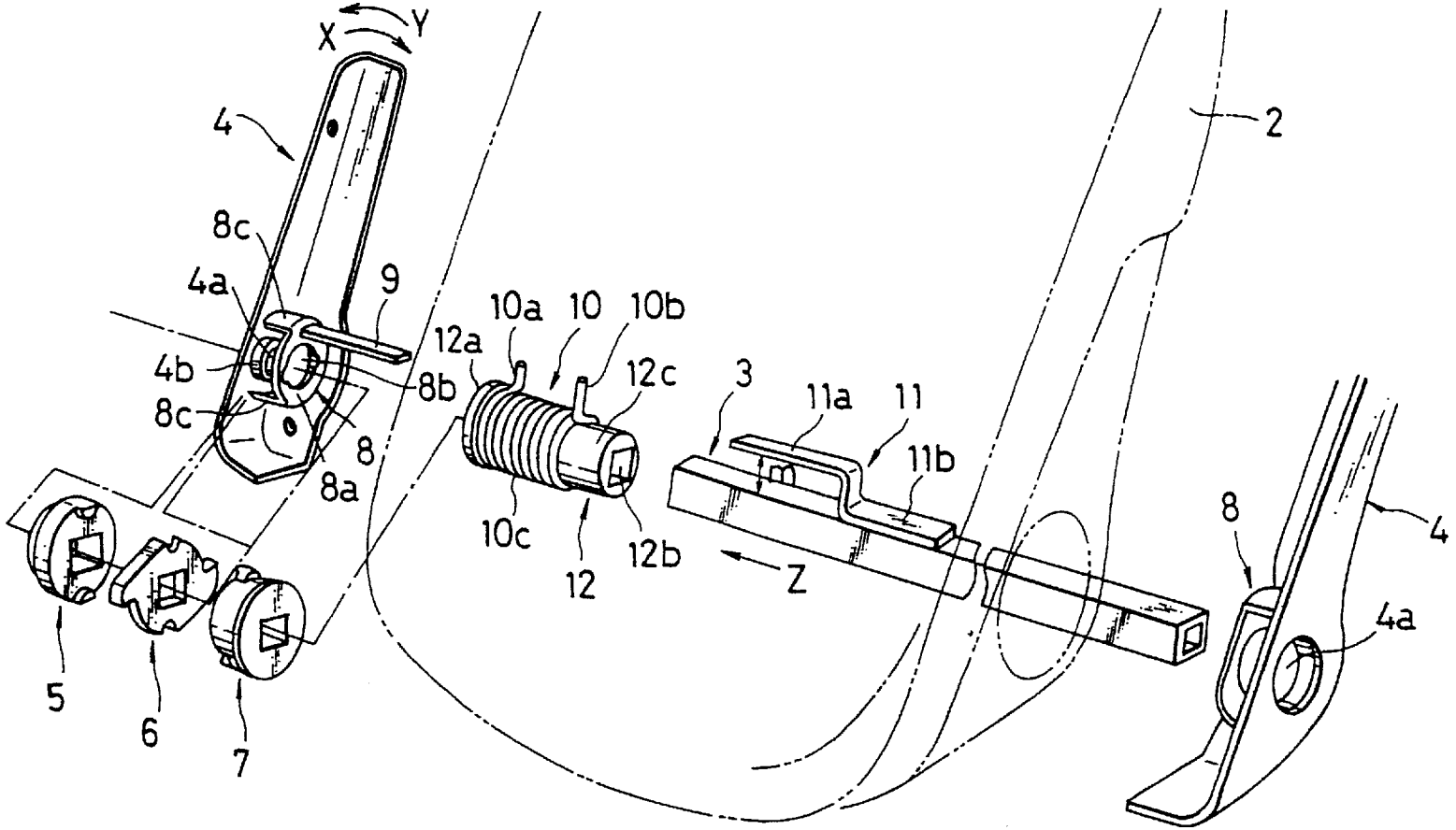
FIG. 2 is an entire perspective view of the respective exploded components of the turning mechanism of the chair seat of FIG. 1.
Figure 3:
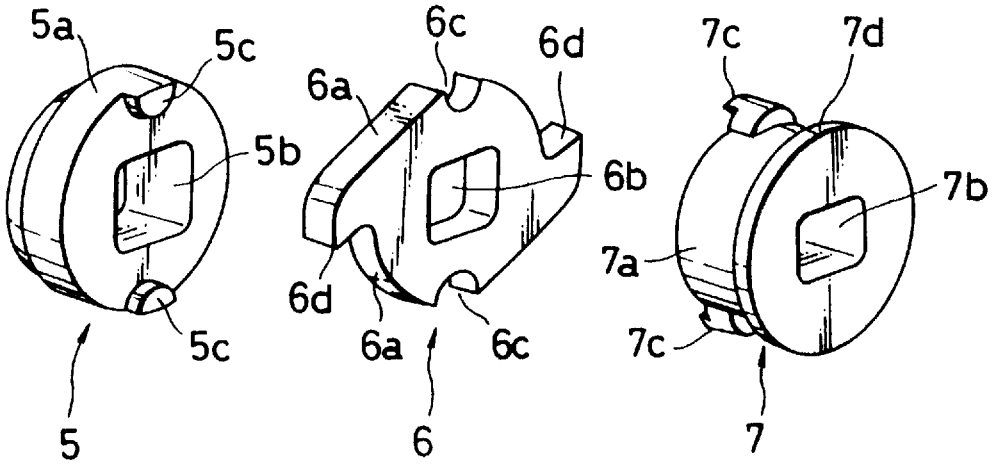
FIG. 3 is an exploded perspective view of the first bushing, the stopper and the second bushing of the turning mechanism of the chair seat of FIG. 1.
Figure 4:
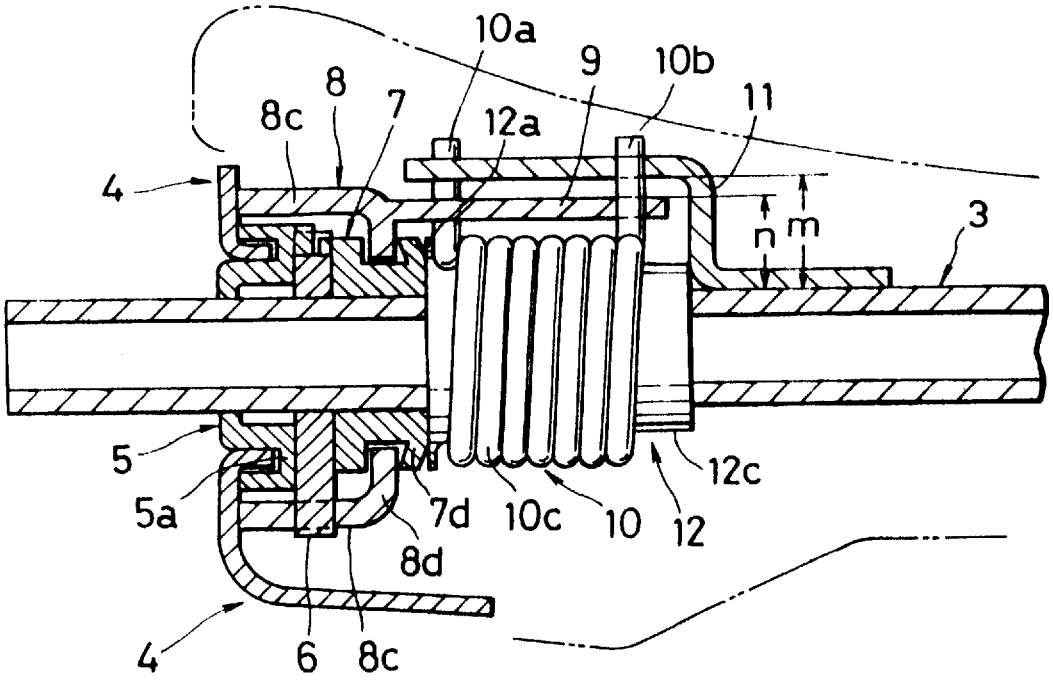
FIG. 4 is a schematic cross sectional view of the assembled main portion of the turning mechanism for the chair seat of FIG. 1 at the seat turning-up position.
Figure 6:
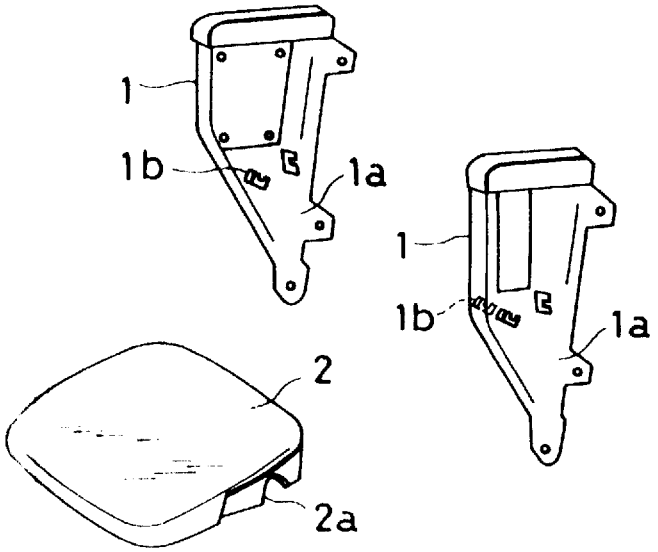
FIG. 6 is a partially exploded perspective view showing other parts of a chair provided with the turning mechanism for the chair seat of FIG. 1.

In FIG. 1 and FIG. 6, legs 1, 1 molded by, for example, die casting or the like stand on both the sides of a position, where each unit chair of connected chairs in conference rooms, halls and the like is installed, with bolts (not shown) screwed into mounting pieces 1*a*, 1*a* located at the lower rear end thereof. A shaft 3, which usually has a square cross section and passes through the cutouts 2*a*, 2*a* of a seat 2 composed of, for example, a blow-molded product or the like, is fixed to shaft stoppers 1*b*, 1*b* projecting from the respective inside surfaces of the legs 1, 1 to thereby secure the side ends of the respective units through different members, so that the seat 2 can be turned to a seat turned up position and a seating position about the fixed shaft 3 as a fulcrum member.

Components constituting a turning mechanism of a chair seat of the embodiment of the present invention will be sequentially described. Arms 4, 4 made by, for example, die casting is fixed to the seat 2, through which the shaft 3 passes, at the rear positions on both the sides thereof by screws (not shown) screwed into mounting holes 4*b*, 4*b* so as to cover the outer peripheries of the rear portion of the seat 2 on both the sides thereof.

In the following description, only one of the arms 4, 4 on both the sides of the chair will be described for simplification.

The arms 4 are formed of a sheet whose thickness is selected so that the surfaces thereof substantially conform to the outer peripheries of the rear portion of the seat 2 on both the side thereof and cylindrical bushing holes 4*a*, 4*a* are defined to the longitudinal surfaces on the inner sides thereof in confrontation with each other.

Each of stopper receivers 8 is formed of a side plate 8*a*, which is perpendicular to the shaft 3 and has a circular bushing hole 8*b* defined at the center thereof and a periphery composed of arc portions confronting each other, and abutting portions 8*c*, 8*c* located at symmetrical positions in parallel with the shaft 3. One end of the abutting portions 8*c*, 8*c* are fixed to the confronting arc portions of the side plate 8*a* and the other end thereof, which extends in the axial direction of the shaft 3, is fixed to the arms 4 at confronting front and rear positions thereof across the bushing hole 4*a*.

A bar-shaped swing piece 9, which has a square cross section, projects from only one of the side plates 8*a* (on the left side in FIG. 1 and FIG. 2) on the inside of the abutting portion 8*c* in parallel with the the shaft axis of the shaft 3.

A stopper 6 is composed of a metal sheet and has a square hole 6*b* defined at the center thereof so as to be engaged with the shaft 3, projecting portions 6*d*, 6*d* and arc portions 6*a*, 6*a* at symmetrical positions of the periphery thereof and arc-shaped recesses 6*c*, 6*c* passing therethrough at confronting positions of the outer side edge thereof.

A first bushing 5 is composed of, for example, a synthetic resin with elasticity and has a square hole 5*b* defined at the center thereof to be engaged with the shaft 3, projections 5*c*, 5*c* each having a semi-circular cross section and defined at confronting positions on the side surface thereof on the inside to be engaged with the recesses 6*c*, 6*c* and a cylindrical portion 5*a* defined to the side surface thereof on the outside and having an outside diameter slidable along the bushing hole 4*a*.

A second bushing 7 is composed of, for example, a synthetic resin with elasticity and has a square hole 7*b* defined at the center thereof to be engaged with the shaft 3, a cylindrical vibration preventing guard portion 7*c* defined to the edge thereof on the inside and having a diameter larger than that of the bushing hole 8*b*, a cylinder portion 7*a* disposed on the outside and having an outside diameter slidable along the bushing hole 8*b* and projections 7*c*, 7*c* disposed at confronting positions of the outer side edge of the cylinder portion 7*a* on the outside to be engaged with the recesses 6*c*, 6*c* in association with the projections 5*c*, 5*c*. It is preferable that the side surface on the inside is formed to a curved portion having a curved surface. If it is formed to a plane, a washer having a curved surface must be prepared as a separate member, thus the number of parts is increased.

A spring guide bushing 12 is composed of, for example, a synthetic resin and has a square hole 12 defined at the center thereof to be engaged with the shaft 3, a cylindrical portion 12*a* on the outer periphery thereof to be engaged with a spring 10 and a cylindrical guard portion 12*c* at the edge thereof on the outside.

The spring 10 is composed of both extreme end portions 10*a*, 10*b* and a main body 10*c* and both the end portions 10*a*, 10*b* can be engaged on the cylindrical portion 12*a* by displacing its phase.

A fixed plate 11 is composed of a base portion 11*b* fixed to the shaft 3 along the lengthwise surface in the axial direction thereof and an extreme end portion 11*a* which is continuous to the base portion 11*b* while keeping a lower surface height m from the surface of the shaft 3 and has a square cross section and a width approximately identical with that of the bar-shaped swing piece 9. The fixed plate 11 is disposed at a neutral position between both the extreme end portions 10*a*, 10*b* of the spring 10 at a seat turned-up position to be described later.

The fixed plate 11, the first bushing 5, the stopper 6, the second bushing 7 and the spring guide bushing 12 are fixed to the shaft 3 which is not affected by the turning of the seat 2 of the chair. Although the cross section of the shaft 3 may be formed to a polygonal shape other than the square shape, since the respective holes 5*b*, 6*b*, 7*b*, 12*b* must be formed to correspond to the polygonal shape, the square shape is most preferable from a view point of machining.

On the other hand, the stopper receiver 8 and the swing piece 9 can be turned in correspondence with the turning of the arm 4 which is turned by the turning of the chair seat 2.

Usually, although the spring 10, the fixed plate 11 and the spring guide bushing 12 are disposed only to the side where the swing piece 9 is provided (the left side in FIG. 1 and FIG. 2) and the first bushing 5, the stoppers 6, the second bushing 7 and the stopper receivers 8 are disposed on both the sides, respectively, the first bushing 5, the stopper 6, the second bushing 7 and the stopper receiver 8, on the right side are disposed at positions symmetrical to the positions where those on the left side are disposed.

How the turning mechanism of the chair seat is assembled will be described with reference to FIG. 1 to FIG. 4.

From the left side, the recesses 6*c*, 6*c* of the stopper 6 are engaged with the projections 5*c*, 5*c* of the cylindrical portion 5a of the first bushing 5, the first 5 is engaged with the projected wall 4*b* formed to the hole 4*a*, the stopper 6 is disposed so that the projections 6*d*, 6*d* of thereof project outwardly of symmetrical positions through a gap formed by the abutting portions 8*c*, 8*c* and the side plate 8*a* of the stopper receiver 8, the cylindrical portion 7*a* of the second bushing 7 is engaged with the bushing hole 8*b* of the stopper receiver 8 from the inside and the projections 7*c*, 7*c* of the second bushing 7 is engaged with the remaining gaps of the recesses 6*c*, 6*c*.

As described above, since each of the projections 5*c*, 5*c* and 7*c*, 7*c* has the semicircular cross section so that they are engaged with the recesses 6*c*, 6*c* in association with each other, the first bushing 5, the stopper 6 and the second bushing 7 can be easily set.

The main body 10*c* of the spring 10 is engaged over the cylindrical portion 12*a* of the spring guide bushing 12, the shaft 3 is inserted into and engaged with the hole 12*b* up to the end of the extreme end portion 11*a* of the fixed plate 11 on the inside in a shaft inserting direction Z and the extreme end portion of the shaft 3 on the outside is set by being inserted into and engaged with, in the Z direction, the respective holes 5*b*, 6*b*, 7*b* of the first bushing 5, the stopper 6 and the second bushing 7 whose square shapes are properly arranged. At the time, the bar-shaped swing piece 9 is adjusted to be located below the extreme end portion 11*a* of the fixed plate 11 between both the end portions 10*a*, 10*b* of the spring 10.

The swing piece 9 is held so as to keep an upper surface height n from the surface of the shaft 3 which is lower than the lower surface height m of the extreme end portion 11*a* therefrom, the shaft 3, the first bushing 5, the stopper 6, the second bushing 7 and the spring guide bushing 12 are fixed without being affected by the turning of the seat 2 and the stopper receiver 8 and the swing piece 9 can be moved in association with the turning of the chair seat 2.

As described above, since the holes 5*b*, 6*b*, 7*b*, 12*b* are arranged to the same shape to permit the shaft 3 to be engage therewith, the shaft 3 can be easily set to these respective holes. Next, operation of the turning mechanism of the chair seat described above will be sequentially described.

Figures 5A, 5B:
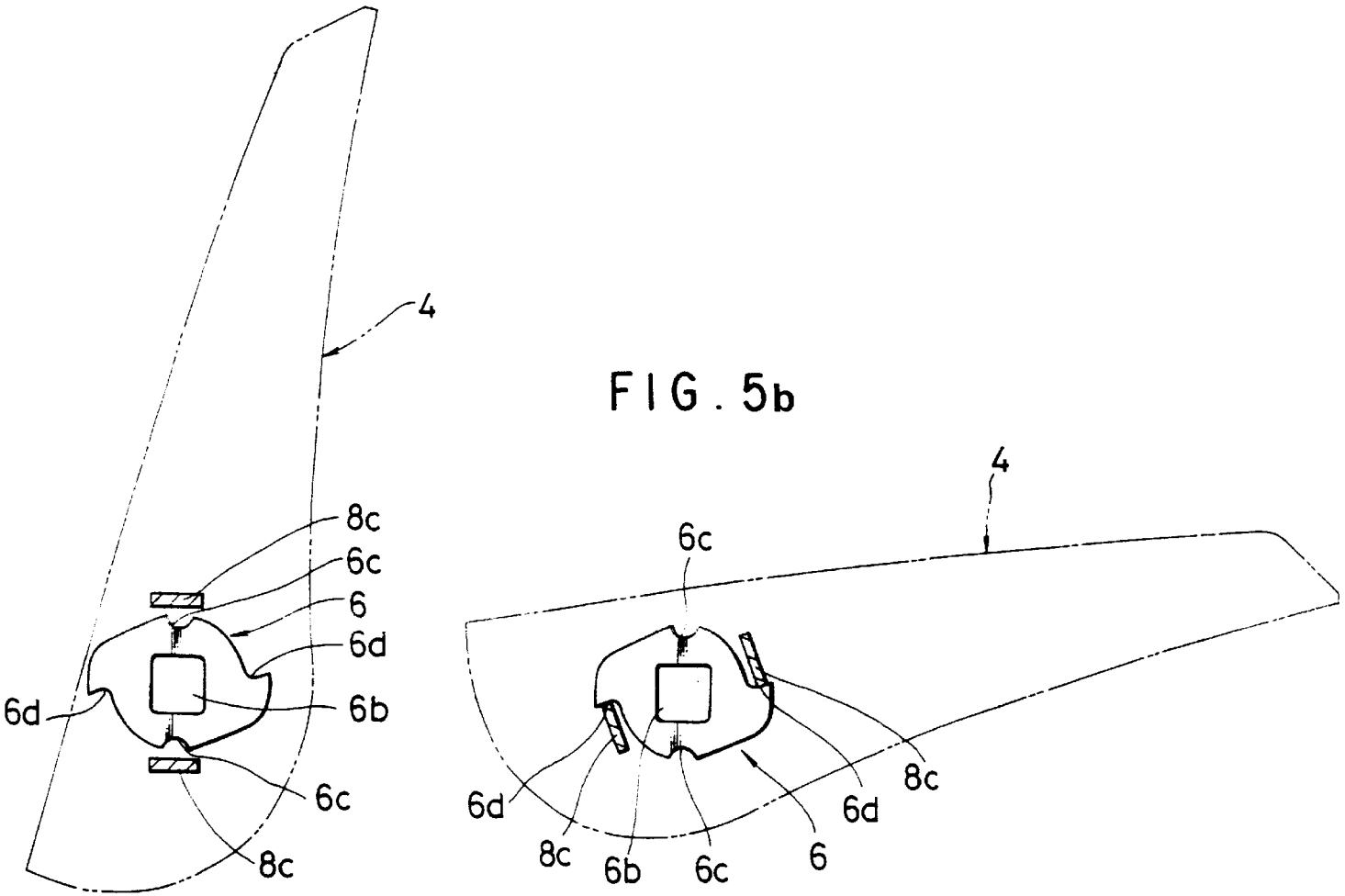
FIG. 5 shows the relationship between the stopper of the turning mechanism of the chair seat of FIG. 1 and the stopper receiver thereof, wherein (a) shows a schematic partial side elevational view of the stopper and the stopper receiver at the seat turned-up position and (b) shows a schematic partial side elevational view of them at a seating position.

FIG. 5(*a*) shows a case that the seat 2 is at a turned-up position, wherein the projections 6*d*, 6*d* of the metal stopper 6 are adjusted to locate at positions where they do not come into contact with the abutting portions 8*c*, 8*c* of the stopper receiver 8.

FIG. 5(*b*) shows a case that the seat 2 is at a sit position, wherein when the seat 2 is turned in a seat turning direction X from the above turned-up position, the stopper receiver 8 which is in association with the turning of the seat 2 is stopped by being abutted against the projections 6*d*, 6*d* fixed to the shaft 3, the swing piece 9 is moved in the seat turning direction while being limited by the stop position and abutted against one of the end portions or the end portion 10*a* of the spring 10 and the extreme end portion 11*a* of the fixed plate 11 fixed to the shaft 3 is abutted against the other end portion 10*b* of the coil spring 10, so that a sitting person can smoothly and easily sit on the chair in the state that the elastic force of the spring 10 is balanced with the weight of the sitting person.

When the seated person stands up, the seat 2 can be automatically turned up in a seat-turning-direction Y from the sit position by the elastic force of the spring 10 and restored to the turned-up position.

Although the aforesaid projections 6*d* and the abutting portions 8*c* need not be disposed at the positions symmetrical to the shaft 3 but each one of them may be disposed, it is preferable that each one pair of them is disposed at the symmetrical positions. This is because of that with this arrangement when the stopper receiver 8 is abutted against the stopper 6 at two positions, a dimension from the center axis to the surface of the stopper receiver 8 where a load is received can be more reduced to thereby reduce a weight and a size, thus the turning mechanism can be mounted to a thin type seat which cannot conventionally contain the stopper receiver and the stopper.

Further, since a load applied to the stopper receiver 8 can be dispersed to the two positions of the first bushing 5 and the second bushing 7 and the distortion of the stopper receiver 8 can be reduced, the weight of parts can be reduced.

According to the turning mechanism for the chair seat of the present invention, since a load applied to the stopper receiver can be dispersed to the two positions of the first bushing 5 and the second bushing 7, the dispersion of the stopper receiver 8 can be reduced and the weight of the parts can be reduced.

Since the dimension from the center axis to the surface of the stopper receiver 8 where the load is received is reduced to thereby reduce the weight and the size, the turning mechanism can be contained in a thin type seat which cannot conventionally contain them.

Further, since the turning mechanism is arranged compactly, a time-consuming job is not required in the assembly of it.

What is claimed is:

1. A turning mechanism for a chair seat, comprising:

a shaft having a square cross section;

a spring disposed on said shaft with an end thereof locked to said shaft and an opposite end thereof engaged so as to be associated with said seat of said chair;

a stopper having a square hole defined at the center thereof, said stopper inserted onto and engaged with said shaft through said square hole in said stopper;

a stopper receiver having abutting portions formed thereto and abutted against projections formed on said stopper;

a first bushing having a square hole defined at the center thereof, said first bushing inserted into and engaged with said shaft through said square hole in said first bushing; and a second bushing having a square hole defined at the center thereof, said second bushing inserted onto and engaged with said shaft through said square hole in said second bushing, wherein said first bushing, said stopper and said second bushing are contained in said stopper receiver.

2. A turning mechanism for a chair seat according to claim 1, wherein said shaft has a cross section formed to a polygonal shape, holes each having a shape identical with the cross section of said shaft are formed in said first bushing, said stopper and said second bushing, respectively and said first bushing, said stopper and said second bushing are integrally arranged as a unit.

3. A turning mechanism for a chair seat according to claim 2, wherein each pair of said projections and said abutting portions are formed at positions symmetrical to said shaft.

4. A turning mechanism for a chair seat according to claim 1, wherein recesses are formed in said stopper and projections to be engaged with said recesses are formed on said first bushing and said second bushing.

5. A turning mechanism for a chair seat according to claim 4, wherein each pair of said projections and said abutting portions are formed at positions symmetrical to said shaft.

6. A turning mechanism for a chair seat according to claim 1, wherein said second bushing is composed of an elastic material and a vibration stopping guard portion is formed on said bushing so as to be engaged with said stopper receiver.

7. A turning mechanism for a chair seat according to claim 6, wherein each pair of said projections and said abutting portions are formed at positions symmetrical to said shaft.

8. A turning mechanism for a chair seat according to claim 1, wherein each pair of said projections and said abutting portions are formed at positions symmetrical to said shaft.

* * * * *